US010074465B2

(12) United States Patent
Hirata et al.

(10) Patent No.: US 10,074,465 B2
(45) Date of Patent: Sep. 11, 2018

(54) METHOD OF MANUFACTURING ELECTRONIC COMPONENT, AND ELECTRONIC COMPONENT

(71) Applicant: Murata Manufacturing Co., Ltd., Nagaokakyo-shi, Kyoto-fu (JP)

(72) Inventors: Yuichi Hirata, Nagaokakyo (JP); Noboru Furukawa, Nagaokakyo (JP); Yasuo Sasaki, Nagaokakyo (JP); Kiyohiro Koto, Nagaokakyo (JP); Kojiro Tokieda, Nagaokakyo (JP); Yukiko Ueda, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/611,826

(22) Filed: Jun. 2, 2017

(65) Prior Publication Data

US 2017/0271056 A1 Sep. 21, 2017

Related U.S. Application Data

(63) Continuation of application No. PCT/JP2015/083312, filed on Nov. 27, 2015.

(30) Foreign Application Priority Data

Dec. 15, 2014 (JP) ..... 2014-253464
Feb. 24, 2015 (JP) ..... 2015-034553

(51) Int. Cl.
*H01C 7/10* (2006.01)
*H01C 7/04* (2006.01)
(Continued)

(52) U.S. Cl.
CPC ..... *H01C 7/041* (2013.01); *H01C 1/142* (2013.01); *H01C 17/245* (2013.01); *H01C 17/281* (2013.01)

(58) Field of Classification Search
CPC ..... H01C 7/041; H01C 1/142; H01C 1/17; H01C 1/245; H01C 17/281
(Continued)

(56) References Cited

U.S. PATENT DOCUMENTS 4,347,650 A * 9/1982 McLarney ..... H01G 4/30 156/89.12
5,280,263 A * 1/1994 Sugaya ..... H01C 7/027 252/502
(Continued)

FOREIGN PATENT DOCUMENTS

JP 57-87113 A 5/1982
JP 60-261122 A 12/1985
(Continued)

OTHER PUBLICATIONS

JP 06-096990, Kuroda et al., Apr. 1994, machine translation.*
(Continued)

*Primary Examiner* — Kyung Lee
(74) *Attorney, Agent, or Firm* — Keating & Bennett, LLP

(57) ABSTRACT

A method of manufacturing an electronic component includes manufacturing a ceramic element including one pair of end surfaces and four side surfaces, forming external electrodes at both end portions of the ceramic element, measuring an initial characteristic value, determining any side surface to be machined among the four side surfaces and then determining, based on stored data, an amount of machining to be performed on the side surface to be machined, and machining, by the determined machining amount, the side surface of the ceramic element, which is determined to be machined, to be flush or substantially flush with the external electrodes.

20 Claims, 13 Drawing Sheets

(51) Int. Cl.
*H01C 17/245* (2006.01)
*H01C 1/142* (2006.01)
*H01C 17/28* (2006.01)

(58) Field of Classification Search
USPC ..... 338/22 R
See application file for complete search history.

(56) References Cited

U.S. PATENT DOCUMENTS 5,493,266 A * 2/1996 Sasaki ..... H01C 1/1406 29/612
6,172,592 B1 * 1/2001 Inoue ..... H01C 1/14 338/22 R
6,311,390 B1 * 11/2001 Abe ..... H01C 7/021 29/612
6,911,893 B2 * 6/2005 Kodama ..... C01G 23/002 257/E29.1
8,803,653 B2 * 8/2014 Tseng ..... H01C 7/02 338/22 R
2002/0089065 A1 7/2002 Fujimoto et al.
2003/0001261 A1 1/2003 Ueda et al.
2010/0236054 A1 9/2010 Hirano et al.
2012/0188683 A1 * 7/2012 Takeuchi ..... H01C 1/148 361/321.2

FOREIGN PATENT DOCUMENTS

JP 04-199801 A 7/1992
JP 06-96990 A 4/1994
JP 06-342704 A 12/1994
JP 08-236308 A 9/1996
JP 09-17607 A 1/1997
JP 11-288806 A 10/1999
JP 2000-235904 A 8/2000
WO 2009/028215 A1 3/2009

OTHER PUBLICATIONS

JP 60-261122, NEC Kansai, Ltd., Dec. 1985, machine translation.*
Official Communication issued in International Patent Application No. PCT/JP2015/083312, dated Feb. 2, 2016.

* cited by examiner

ONE-SIDE POLISHING (POLISHING OF ONE SIDE SURFACE)

BOTH-SIDE POLISHING
(POLISHING OF TWO SIDE SURFACES)

METHOD OF MANUFACTURING ELECTRONIC COMPONENT, AND ELECTRONIC COMPONENT

CROSS REFERENCE TO RELATED APPLICATIONS

This application claims the benefit of priority to Japanese Patent Application No. 2014-253464 filed on Dec. 15, 2014 and Japanese Patent Application No. 2015-034553 filed on Feb. 24, 2015, and is a Continuation Application of PCT Application No. PCT/JP2015/083312 filed on Nov. 27, 2015. The entire contents of each application are hereby incorporated herein by reference.

BACKGROUND OF THE INVENTION

1. Field of the Invention

The present invention relates to a method of manufacturing an electronic component, and particularly relates to a method of manufacturing an electronic component having a high characteristic accuracy.

The present invention also relates to an electronic component, and particularly relates to an electronic component having a high characteristic accuracy.

2. Description of the Related Art

Improvement of the functionality and accuracy of an electronic device requires a high characteristic accuracy of an electronic component used in the electronic device. In particular, to achieve safety, a higher characteristic accuracy is required for an electronic component used in a medical or on-board electronic device. For example, an NTC thermistor is required to have a resistance value within a range of ±0.2% of a target resistance value or within a smaller range in some cases.

Japanese Patent Laid-Open No. 9-17607, Japanese Patent Laid-Open No. 8-236308, and Japanese Patent Laid-Open No. 2000-235904 each disclose a method of manufacturing a chip thermistor, the resistance value of which is adjusted at high accuracy.

In the method of manufacturing a thermistor disclosed in Japanese Patent Laid-Open No. 9-17607, the resistance value is adjusted as follows.

First, a plurality of ceramic green sheets on which internal-electrode conductive paste is printed in advance are laminated, and a plurality of ceramic green sheets on which no conductive paste is printed are laminated above and below the ceramic green sheets. Then, this laminated body is fired to obtain a ceramic element.

Subsequently, external-electrode conductive paste is applied and baked at both ends of the ceramic element to form baked external electrodes.

Subsequently, an initial resistance value between the baked external electrodes is measured to classify the ceramic element depending on the value.

Subsequently, for each classified ceramic element, part of the baked external electrodes and part of a ceramic part of the ceramic element are machined with different machining width and depth to obtain a resistance value within the allowable range of a target resistance value set in advance.

Subsequently, resin resistant against plating solution is applied on the machined part and cured to form an insulating resin film.

Subsequently, a plated external electrode is formed on each baked external electrode by plating, which completes manufacturing of a thermistor having a resistance value within the allowable range of the target resistance value. The insulating resin film is left intact as part of a product.

In the method of manufacturing a thermistor disclosed in Japanese Patent Laid-Open No. 8-236308, the resistance value is adjusted as follows.

First, a ceramic element is prepared.

Subsequently, conductive paste is applied on one of principal surfaces of the ceramic element to form one pair of facing surface electrodes (the surface electrodes are formed in a plurality of pairs in some cases). Conductive paste is applied at both end parts of the ceramic element to form one pair of external electrodes (terminal electrode). One of the surface electrodes is connected with one of the external electrodes, whereas the other surface electrode is connected with the other external electrode.

Subsequently, the ceramic element on which conductive paste is applied is fired to bake the surface electrodes and the external electrodes onto the ceramic element.

Subsequently, a leading end part of each of the surface electrodes formed on the one principal surface of the ceramic element is removed by barrel polishing or sandblasting to increase the distance between the facing surface electrodes, thus adjusting the resistance value. This completes manufacturing of a thermistor having a resistance value within the allowable range of a target resistance value.

Although Japanese Patent Laid-Open No. 8-236308 provides no detail on measurement of the resistance value along with the adjustment of the resistance value, the measurement can be performed as appropriate before or during the removal of the leading end part of each surface electrode.

In the method of manufacturing a thermistor disclosed in Japanese Patent Laid-Open No. 2000-235904, the resistance value is adjusted as follows.

First, a ceramic element is prepared. One pair of internal electrodes is buried inside the ceramic element.

Subsequently, conductive paste is applied and baked at both end parts of the ceramic element to form one pair of external electrodes. As a result, one of the internal electrodes is connected with one of the external electrodes, whereas the other internal electrode is connected with the other external electrode.

Subsequently, an initial resistance value between the external electrodes is measured to classify the ceramic element depending on the value.

Subsequently, a resist film that resistant to a solvent is formed on a surface of the ceramic element on which the external electrodes are formed. The resist film is formed in a cap shape at each end part of the ceramic element to cover the corresponding external electrode. Accordingly, part of a ceramic part of the ceramic element is externally exposed from the resist film.

Subsequently, the ceramic element on which the resist film is formed is immersed in a solvent of, for example, nitric acid, sulfuric acid, or phosphoric acid for a different time duration in accordance with the above-described classification depending on the initial resistance value. As a result, the ceramic part of the ceramic element exposed from the resist film is eroded. The depth of the erosion changes with the immersion time duration. The resistance value between the external electrodes of each ceramic element is adjusted to be within the allowable range of a target resistance value.

Subsequently, the resist film is removed, which completes manufacturing of a thermistor having a resistance value within the allowable range of the target resistance value.

However, the methods disclosed in Japanese Patent Laid-Open No. 9-17607, Japanese Patent Laid-Open No.

8-236308 and Japanese Patent Laid-Open No. 2000-235904, in which a characteristic value of an electronic component is adjusted, have the following problems.

First, in the method of adjusting a characteristic value (resistance value) of an electronic component disclosed in Japanese Patent Laid-Open No. 9-17607, after an initial characteristic value (initial resistance value) is measured, the classification is performed, and for each classified ceramic element, part of each baked external electrode and part of the ceramic part of the ceramic element are machined with different machining width and depth to obtain a characteristic value within the allowable range of a target characteristic value (target resistance value) set in advance. However, the machining of part of each baked external electrode and part of the ceramic part of the ceramic element is extremely cumbersome, which leads to a complicated and high-cost manufacturing process. Specifically, when the machining is to be performed by sandblasting, a protection film needs to be formed in advance on a region not to be machined so as to accurately machine a region to be machined. Then, after the sandblast is performed, the protection film needs to be removed.

In the method of adjusting a characteristic value of an electronic component disclosed in Japanese Patent Laid-Open No. 9-17607, after part of each baked external electrode and part of the ceramic part of the ceramic element are machined, resin resistant against a plating solution is applied on the machined part and cured to form an insulating resin film, and then a plated external electrode is formed on the baked external electrode by plating. This process of forming the resin film also leads to a cumbersome, complicated, and high-cost manufacturing process.

As described above, the method of adjusting a characteristic value of an electronic component disclosed in Japanese Patent Laid-Open No. 9-17607 leads to a cumbersome, complicated, and high-cost manufacturing process, and thus is not suitable for mass production for which high productivity is required.

In the method of adjusting a characteristic value (resistance value) of an electronic component disclosed in Japanese Patent Laid-Open No. 8-236308, the leading end part of each of one pair of surface electrodes formed on one of principal surfaces of the ceramic element is removed to increase the distance between the facing surface electrodes, thus adjusting the characteristic value. The distance between the surface electrodes is a factor largely affecting the characteristic value (resistance value). In the electronic component disclosed in Japanese Patent Laid-Open No. 8-236308, this important configuration is exposed on the surface of the ceramic element. Specifically, for example, any loss of the leading end part of a surface electrode when the electronic component is mounted after completely manufactured may potentially cause significant change of the characteristic value.

As described above, in the method of adjusting a characteristic value of an electronic component disclosed in Japanese Patent Laid-Open No. 8-236308, the characteristic value of the completed electronic component may potentially change, which results in manufacturing of an electronic component with low temporal characteristic reliability.

In the method of adjusting a characteristic value (resistance value) of an electronic component disclosed in Japanese Patent Laid-Open No. 2000-235904, the resist film is formed in a cap shape to cover the external electrodes, on the surface of the ceramic element on which the external electrodes are formed. Then, the ceramic element is immersed in a solvent of, for example, nitric acid, sulfuric acid, or phosphoric acid to erode the ceramic part of the ceramic element, thus adjusting the characteristic value. However, the adjustment of the characteristic value (resistance value) only through the erosion of the ceramic part without machining of the external electrodes typically requires a high amount (depth) of erosion of the ceramic part. However, when part of the ceramic part of the ceramic element is largely (deeply) eroded, the strength of the ceramic element is reduced. Specifically, the method of adjusting a characteristic value of an electronic component disclosed in Japanese Patent Laid-Open No. 2000-235904 potentially reduces the strength of a completed electronic component, which results in manufacturing of an electronic component with low strength reliability.

The method of adjusting a characteristic value of an electronic component disclosed in Japanese Patent Laid-Open No. 2000-235904 requires a process of forming, on the surface of the ceramic element, the resist film against a solvent, a process of eroding the ceramic part by immersing, in the solvent, the ceramic element on which the resist film is formed, and a process of removing the resist film, which leads to a cumbersome, complicated, and high-cost manufacturing process.

As described above, the method of adjusting a characteristic value of an electronic component disclosed in Japanese Patent Laid-Open No. 2000-235904 leads to reduced strength reliability of a completed electronic component, and also leads to a cumbersome, complicated, and high-cost manufacturing process.

SUMMARY OF THE INVENTION

Preferred embodiments of the present invention provide methods of manufacturing electronic components having a high characteristic accuracy, which does not degrade temporal reliability and strength reliability of a characteristic of an electronic component, nor lead to a cumbersome, complicated, and high-cost manufacturing process, and provide electronic components having a high characteristic accuracy.

A method of manufacturing an electronic component according to a preferred embodiment of the present invention includes a ceramic element manufacturing process of manufacturing a ceramic element with a rectangular parallelepiped or a substantially rectangular parallelepiped including one pair of end surfaces and four side surfaces each connecting the end surfaces; an external electrode forming process of forming, at both end portions of the ceramic element, one pair of external electrodes each having a cap shape over the corresponding end surface and the four side surfaces continuous with the end surface; an initial characteristic value measuring process of measuring an initial characteristic value between the external electrodes; a machining condition determining process of determining one side surface, two side surfaces, or three side surfaces to be machined from among the four side surfaces and then determining, based on stored data, an amount of machining to be performed on the determined one side surface, two side surfaces, or three side surfaces by comparing the initial characteristic value measured through the initial characteristic value measuring process and a predetermined target characteristic value; and a side surface machining process of machining the determined one side surface, two side surfaces, or three side surfaces to be flush or substantially flush with the external electrodes formed on the side surface by the machining amount determined by the machining condition determining process.

The characteristic value is, for example, a resistance value. However, the characteristic value is not limited to the resistance value, but may be, for example, an inductance value or a capacitance value.

The external electrode forming process may include, for example, a baked external electrode forming process of forming a baked external electrode by applying and baking conductive paste at both end portions of the ceramic element. In this case, the external electrodes are able to be formed through a lower number of processes.

The external electrode forming process may include, for example, a baked external electrode forming process of forming a baked external electrode by applying and baking conductive paste at both end portions of the ceramic element, and a plated external electrode forming process of forming a plated external electrode on the baked external electrode by plating. In this case, highly reliable external electrodes are able to be provided.

Each external electrode preferably is in ohmic contact with the ceramic element, for example. In this case, the resistance value has a high increase rate relative to the amount of machining any side surface, and the characteristic value is able to be easily adjusted with a small machining amount.

The ceramic element may be a thermistor element, and the electronic component may be a thermistor, for example.

An internal electrode may be formed inside the ceramic element, for example.

The appearance of the ceramic element may have various kinds of shapes and dimensions. However, preferably, one pair of surfaces on which external electrodes are mainly formed is defined to be end surfaces, and four surfaces connecting the end surfaces are defined to be side surfaces, for example.

For example, each end surface of the ceramic element may be rectangular or substantially rectangular including a first side and a second side orthogonal or substantially orthogonal to each other, and the length of a longer one of the first and second sides may be less than or equal to the length of each side surface between the end surfaces. The length of the first side may be equal or substantially equal to the length of the second side, for example, and in this case, each end surface of the ceramic element is square or substantially square.

Alternatively, each end surface of the ceramic element may be rectangular or substantially rectangular including a first side and a second side orthogonal or substantially orthogonal to each other, and the length of a longer one of the first and second sides may be longer than the length of each side surface between the end surfaces, for example.

The length of the first side may be equal or substantially equal to the length of the second side, for example, and in this case, each end surface of the ceramic element is square or substantially square. However, when the lengths of the first and second sides are set different from each other, for example, a lead terminal is able to be disposed in parallel or substantially in parallel to the longer one of the first and second sides and solidly joined with an external electrode through a lead terminal joining process.

The method may further include the lead terminal joining process of joining a lead terminal with each external electrode, for example. In this case, a lead-terminal electronic component including a lead terminal is provided in place of a chip electronic component, which is mainly surface-mounted for use.

In this case, the method may further include, after the lead terminal joining process, a characteristic value adjusting process of adjusting the characteristic value by machining the ceramic element or machining the ceramic element and the external electrodes, for example. In this case, the characteristic value is able to be adjusted after the lead terminals are joined, and an electronic component having a higher characteristic accuracy is able to be manufactured.

In this case, the method may further include an exterior sealing process of sealing, by an exterior, the ceramic element on which the external electrodes are formed, leaving one end of each lead terminal externally exposed, for example. In this case, an electronic component, the body of which is protected by the exterior, is able to be manufactured.

An electronic component according to a preferred embodiment of the present invention includes a ceramic element with a rectangular parallelepiped or a substantially rectangular parallelepiped shape including one pair of end surfaces and four side surfaces each connecting the end surfaces; and one pair of external electrodes provided on both end surfaces of the ceramic element. Each external electrode extends from the corresponding end surface to one side surface, two side surfaces, or three side surfaces of four side surfaces continuous with the end surface over a side surrounding the end surface. Any side surface of the ceramic element, to which no external electrode extends, is machined to be flush or substantially flush.

Each external electrode may only include, for example, a baked external electrode provided on the ceramic element. In this case, the external electrodes are able to be formed through a lower number of processes.

Each external electrode may include, for example, a baked external electrode provided on the ceramic element and a plated external electrode provided on the baked external electrode. In this case, highly reliable external electrodes are able to be provided.

Each external electrode preferably is in ohmic contact with the ceramic element, for example. In this case, the characteristic value has a high increase rate relative to the amount of machining any side surface, and the characteristic value is able to be adjusted with a small machining amount.

The ceramic element may be a thermistor element, and the electronic component may be a thermistor, for example.

An internal electrode may be provided inside the ceramic element, for example.

The ceramic element may have various kinds of shapes and dimensions. For example, each end surface of the ceramic element may be rectangular or substantially rectangular including a first side and a second side orthogonal or substantially orthogonal to each other, and the length of a longer one of the first and second sides may be less than or equal to the length of each side surface between the end surfaces. The length of the first side may be equal or substantially equal to the length of the second side, for example, and in this case, each end surface of the ceramic element preferably is square or substantially square.

Alternatively, each end surface of the ceramic element may be rectangular or substantially rectangular including a first side and a second side orthogonal or substantially orthogonal to each other, and the length of a longer one of the first and second sides may be longer than the length of each side surface between the end surfaces, for example.

The length of the first side may be equal or substantially equal to the length of the second side, for example, and in this case, each end surface of the ceramic element is square or substantially square. However, when the lengths of the first and second sides are set different from each other, for example, a lead terminal is able to be disposed in parallel or substantially in parallel to the longer one of the first and second sides and solidly joined with an external electrode through a lead terminal joining process.

A lead terminal may be joined with each external electrode, for example. In this case, a lead-terminal electronic component including a lead terminal is provided in place of a chip electronic component, which is mainly surface-mounted for use.

In this case, the ceramic element on which the external electrodes are located may be sealed by an exterior, leaving one end of each lead terminal externally exposed, for example. In this case, the body of the electronic component is able to be protected by the exterior.

A method of manufacturing an electronic component according to a preferred embodiment of the present invention is able to easily manufacture an electronic component having a high characteristic accuracy, without involving a cumbersome, complicated, and high-cost manufacturing process.

An electronic component according to a preferred embodiment of the present invention has a high characteristic accuracy and is able to be easily manufactured at low cost, thus providing high productivity.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 2A to 2C, are each a cross-sectional view showing a process performed in the exemplary method of manufacturing the NTC thermistor shown in FIG. 1A.

DETAILED DESCRIPTION OF THE PREFERRED EMBODIMENTS

First Preferred Embodiment

Figure 1A:
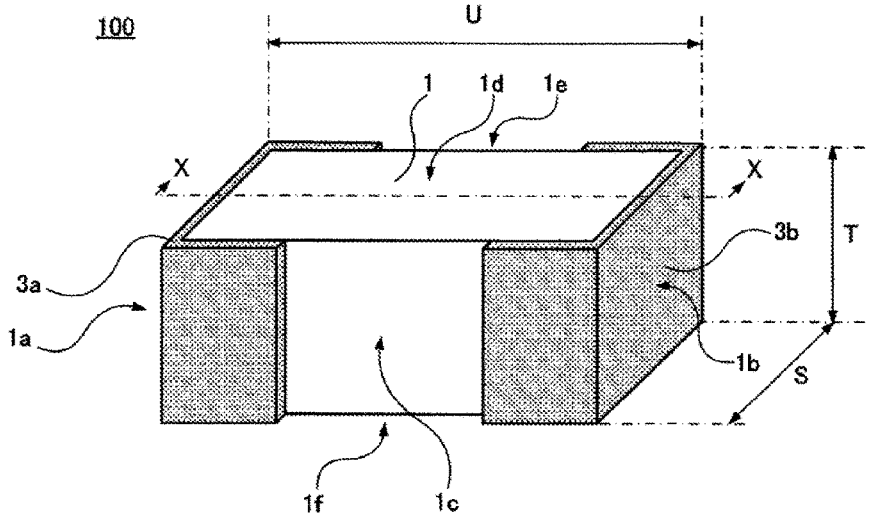
FIG. 1A is a perspective view showing an NTC thermistor according to a first preferred embodiment of the present invention.
Figure 1B:
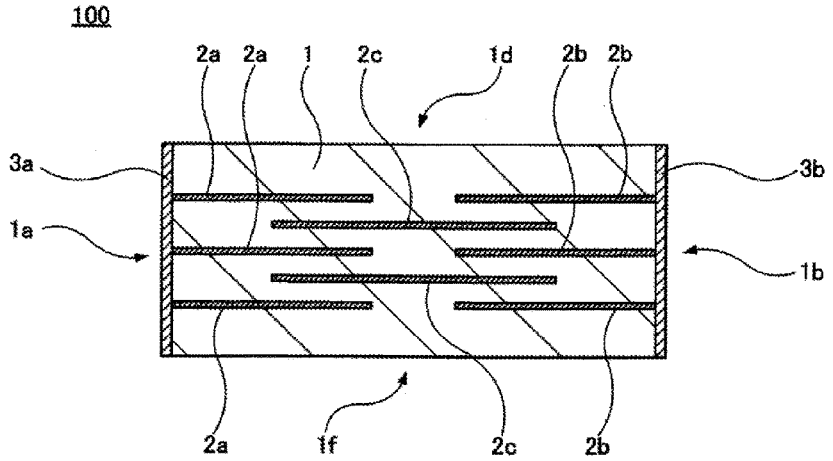
FIG. 1B is a cross-sectional view taken along line X-X in FIG. 1A.

FIGS. 1A and 1B show an NTC thermistor 100 as an electronic component according to a first preferred embodiment of the present invention. FIG. 1A is a perspective view, and FIG. 1B is a cross-sectional view taken along line X-X in FIG. 1A.

The NTC thermistor 100 is a chip electronic component that may be, for example, surface-mounted.

The NTC thermistor 100 includes a ceramic element 1 with a rectangular parallelepiped or a substantially rectangular parallelepiped shape including one pair of end surfaces 1*a* and 1*b* and four side surfaces 1*c*, 1*d*, 1*e*, and 1*f* connecting the end surfaces 1*a* and 1*b*.

In the NTC thermistor 100 according to the present preferred embodiment, the end surfaces 1*a* and 1*b* of the ceramic element 1 are each rectangular or substantially rectangular including a first side having a length S and a second side having a length T, which are orthogonal or substantially orthogonal to each other. The length S of the first side is longer than or equal to the length T of the second side. The length S of the first side as the longer side is less than or equal to a length U of each of the side surfaces 1*c*, 1*d*, 1*e*, and 1*f* between the end surface 1*a* and the end surface 1*b*. In FIG. 1A, the lengths S, T, and U each include thicknesses of the external electrodes 3*a* and 3*b*, to be described below, which are extremely small.

Specific dimensions of the lengths S, T, and U are optional, and may be, for example, dimensions of S=about 0.8 mm, about 0.5 mm≤T≤about 0.8 mm, and U=about 1.6 mm.

The ceramic element 1 includes a composite oxide semiconductor obtained by mixing a plurality of types of fiber metallic oxide, for example, Mn, Co, Ni, Cu, and Fe and sintering the mixture at a high temperature of, for example, about 1200 to about 1500° C., approximately.

In the present preferred embodiment, internal electrodes 2*a*, 2*b*, and 2*c* are thick rectangular or substantially rectangular films buried inside the ceramic element 1. The internal electrodes 2*a*, 2*b*, and 2*c* each include a primary component, for example, Ag, Pd, Ag—Pd, or Pt, which makes ohmic contact with the ceramic element 1. One side of the internal electrode 2*a* is externally exposed from the end surface 1*a* as one end surface of the ceramic element 1. One side of the internal electrode 2*b* is externally exposed from the end surface 1*b* as the other end surface of the ceramic element 1. The internal electrode 2*c* is a floating electrode, and is not externally exposed from the ceramic element 1. A portion of the internal electrode 2*c* faces portions of the internal electrode 2*a* and the internal electrode 2*b*.

The external electrodes 3*a* and 3*b* are provided at both end portions of the ceramic element 1.

The external electrode 3*a* is provided on the end surface 1*a* as one end surface of the ceramic element 1 and extends to the two side surfaces 1*c* and 1*e* over two facing sides of four sides surrounding the end surface 1*a*. The external electrode 3*b* is provided on the end surface 1*b* as the other end surface of the ceramic element 1 and extends to the two side surfaces 1*c* and 1*e* over two facing sides of four sides surrounding the end surface 1*b*. In other words, the external electrodes 3*a* and 3*b* preferably are C shaped, with depth, at the respective end portions of the ceramic element 1.

The two facing side surfaces 1*d* and 1*f* of the ceramic element 1, on which the external electrodes 3*a* and 3*b* are not extended, are machined to be flush or substantially flush with each other. This flush or substantially flush machining of the two side surfaces 1*d* and 1*f* is performed to adjust the resistance value (as an example of a characteristic value) of the NTC thermistor 100 to be within a desired range of a predetermined target resistance value (as an example of a target characteristic value) as described below.

Although not shown in the drawings, the external electrodes 3*a* and 3*b* each include a baked external electrode directly formed on the ceramic element 1, and a plated external electrode formed on the baked external electrode. The baked external electrode includes a primary component, for example, Ag—Pd, Ag, or Cu. The plated external electrode includes, for example, two layers of a Ni-plated first layer and a Sn-plated second layer.

In the NTC thermistor 100 according to the present preferred embodiment, the external electrodes 3*a* and 3*b* preferably are formed as a baked external electrode and a plated external electrode, but may be both formed as baked external electrodes, for example.

In the NTC thermistor 100 according to the present preferred embodiment, the side surfaces 1*d* and 1*f* of the ceramic element 1 are machined to be flush or substantially flush with the external electrodes 3*a* and 3*b* to have an adjusted characteristic value (for example, a resistance value), thus providing an extremely high resistance value accuracy (for example, a characteristic accuracy).

The following describes an exemplary method of manufacturing the NTC thermistor 100 according to the present preferred embodiment. The method of manufacturing the NTC thermistor 100 according to the present preferred embodiment includes processes described below.

First, although not shown in the drawings, starting materials, for example, $Mn_3O_4$ powder, $Co_3O_4$ powder, and NiO powder, are weighed to provide a predetermined composition and wet-mixed by a ball mill. Subsequently, the mixed materials are calcined at, for example, about 900° C. Subsequently, the calcined materials are crushed again by the ball mill and then mixed together with dispersant and an organic binder to provide slurry.

Subsequently, the slurry is shaped by a doctor blade method to provide a ceramic green sheet. Subsequently, the ceramic green sheet is cut into rectangles or substantial rectangles each having a relatively large area to form mother sheets for manufacturing a high number of NTC thermistors all at once.

Subsequently, conductive paste including a primary component, for example, Ag—Pd is printed on the principal surface of each of predetermined mother sheets to form an internal-electrode pattern having a desired shape. However, the internal-electrode pattern is not formed on some of the mother sheets.

Subsequently, the mother sheets on each of which the internal-electrode pattern is formed are laminated in a predetermined order. Then, the mother sheets on each of which the internal-electrode pattern is not formed are laminated above and below the laminated mother sheets on each of which the internal-electrode pattern is formed, and bonded by pressure to provide a mother laminated body. Subsequently, the mother laminated body is cut at predetermined dimensions to provide a plurality of ceramic bodies to be fired.

Figure 2A:
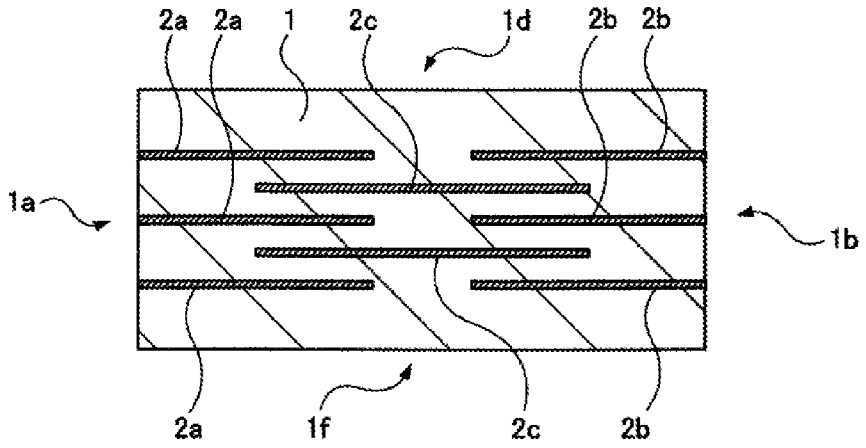
FIGS. 2A to 2C are each a cross-sectional view showing a process performed in an exemplary method of manufacturing the NTC thermistor shown in FIG. 1A.

Subsequently, each ceramic element to be fired is heated in air to perform debinder processing. Subsequently, the ceramic element is fired, for example, at about 1100° C. in air to provide the ceramic element 1 as shown in FIG. 2A.

In the present preferred embodiment, the fired ceramic element 1 preferably has a width of about 0.72 mm, a length of about 1.52 mm, and a height of about 0.72 mm, for example. Barrel polishing may be performed, for example, to trim the profile of the ceramic element 1.

Figure 2B:
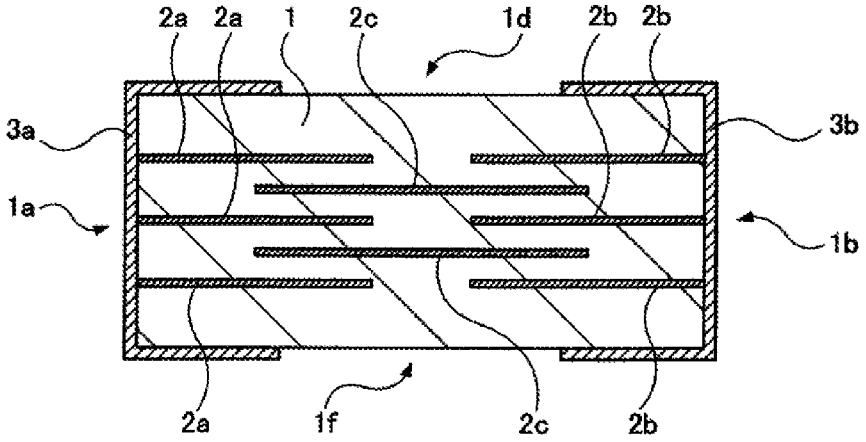

Subsequently, as shown in FIG. 2B, the external electrodes 3*a* and 3*b* are formed at both end portions of the ceramic element 1. Specifically, first, conductive paste including a primary component, for example, Ag—Pd, is applied at both end portions of the ceramic element 1, and baked to form a baked external electrode (not shown in the drawings). Subsequently, a plated external electrode (not shown in the drawings) including a Ni-plated first layer and a solder-plated second layer is formed on the baked external electrode by electrolytic plating.

Subsequently, an initial resistance value (as an example of an initial characteristic value) between the external electrodes 3*a* and 3*b* is measured for each ceramic element 1. Then, the ceramic element 1 is classified into one of a plurality of groups depending on the initial resistance value.

A correlation diagram between the amount (for example, by percent) of machining the ceramic element 1 and an increased amount (for example by percent) of the resistance value is produced in advance before manufacturing of the NTC thermistor 100. Specifically, a plurality of sample experiments are performed in advance to obtain a correlation relation between a machining amount of the ceramic element 1 and an increase the resistance value by a certain amount.

Figure 4A:
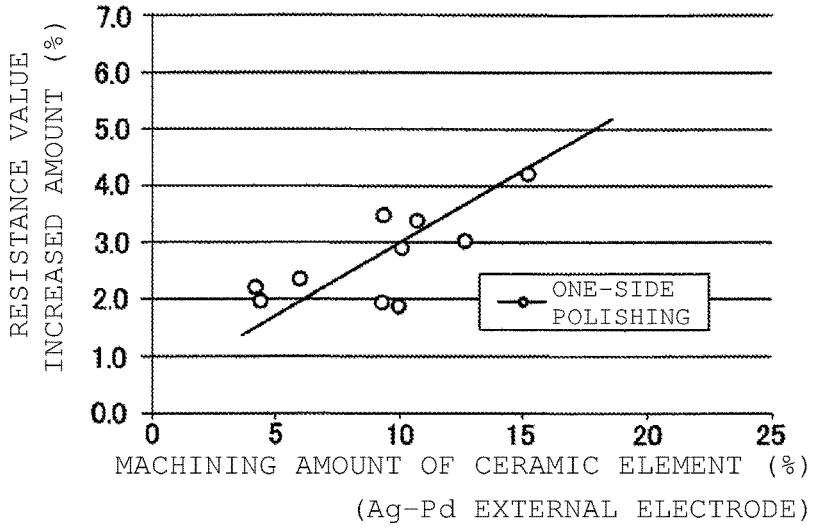
FIG. 4A is a correlation diagram showing an exemplary correlation relation between the amount of machining a ceramic element and the increased amount of the resistance value thereof in one-side polishing.
Figure 4B:
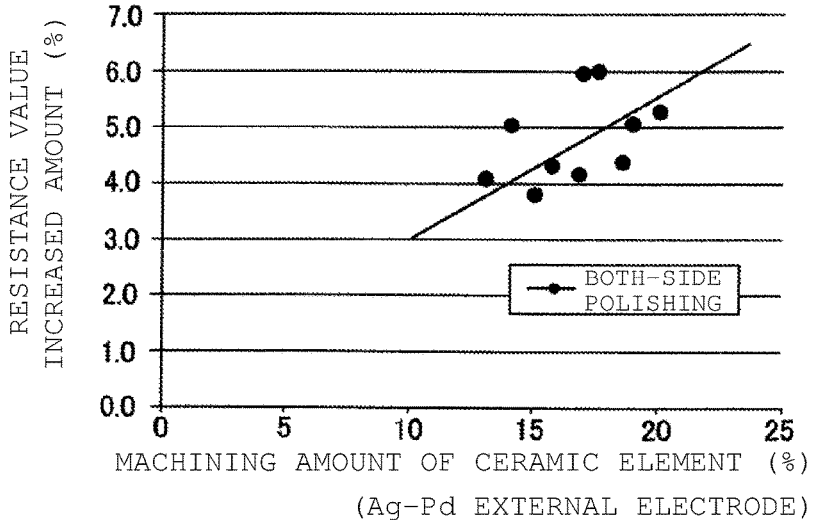
FIG. 4B is a correlation diagram showing an exemplary correlation relation between the amount of machining the ceramic element and the increased amount of the resistance value thereof in both-side polishing.

FIGS. 4A and 4B each show an exemplary correlation diagram between the machining amount and the increased amount of the resistance value. FIG. 4A shows a case of polishing one side surface of the ceramic element 1. FIG. 4B shows a case of polishing the back side surface of the ceramic element 1, one side surface of which is polished to produce the diagram of FIG. 4A. In FIGS. 4A and 4B, the machining amount does not include the amounts of machining the external electrodes 3*a* and 3*b*.

For example, in the correlation diagram of FIG. 4A, a correlation equation of $y=0.2354x+0.7562$ holds, where x represents the machining amount, and y represents the increased amount of the resistance value.

Thus, for example, when one side surface of the ceramic element 1 is machined by about 10%, the resistance value increases by about 3.1%, approximately.

Figure 5:
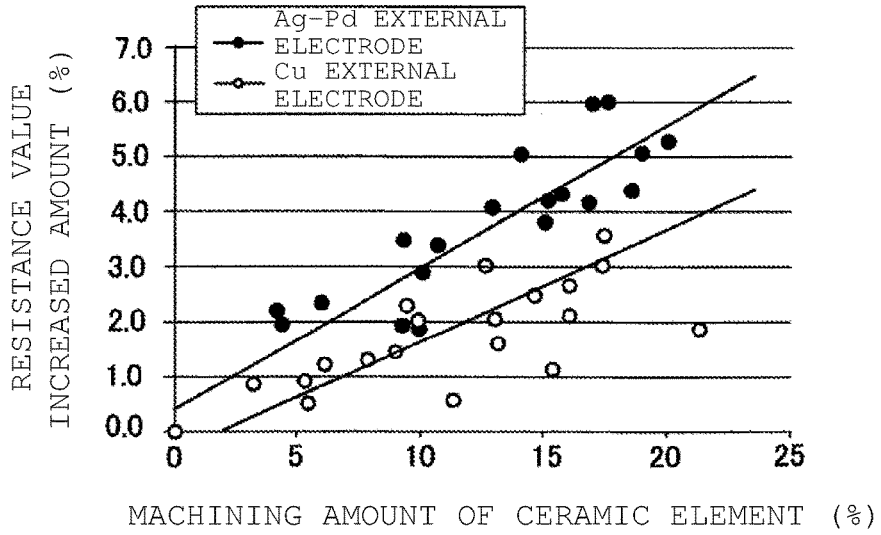
FIG. 5 is a correlation diagram showing a difference between different external electrodes in a correlation relation between the amount of machining the ceramic element and the increased amount of the resistance value thereof.

The resistance value tends to have a larger rate of increasing when the baked external electrode has ohmic contact with the ceramic element 1 than when the baked external electrode has no ohmic contact with the ceramic element 1. FIG. 5 shows the correlation diagram when the baked external electrode includes a primary component of Ag—Pd having ohmic contact with the ceramic element 1, and the correlation diagram when the baked external electrode includes a primary component of Cu having no ohmic contact with the ceramic element 1. As shown in FIG. 5, the resistance value has a larger increase rate and the correlation equation has a slightly larger gradient when the primary component is Ag—Pd than when the primary component is Cu. Thus, in the present preferred embodiment, the baked external electrode preferably includes a primary component having ohmic contact with the ceramic element 1, for example, because the resistance value is able to be more greatly increased with a lower machining amount.

The machining of the ceramic element 1 may be performed on one side surface of the ceramic element 1 or two facing side surfaces thereof. The machining of one side surface involves a lower number of processes, thus providing high productivity. The machining of two side surfaces is able to provide a completed electronic component having a vertically symmetrical or substantially vertically symmetrical shape. The number of machined side surfaces is not limited to one or two, and three continuous side surfaces may be machined.

However, the above-described correlation equation differs depending on the number of side surfaces of a machined ceramic element and the positions thereof, in some cases. In such a case, the correlation diagram is produced in accordance with the number of side surfaces of the machined ceramic element and the positions thereof.

When any of the appearance dimensions of width, length, and height of the ceramic element 1 is different from a target dimension, a machined side surface of the ceramic element 1 is preferably determined, for example, to correct the dimension, thus adjusting the resistance value as well as the dimension.

Any side surface to be machined and the machining amount are determined for each ceramic element 1, which is classified depending on its initial resistance value, based on the produced correlation diagram between the amount of machining the ceramic element 1 and the increased amount of the resistance value. In the NTC thermistor 100 according to the present preferred embodiment, the facing side surfaces 1*d* and 1*f* of the ceramic element 1 are determined to be machined by predetermined amounts.

Figure 2C:
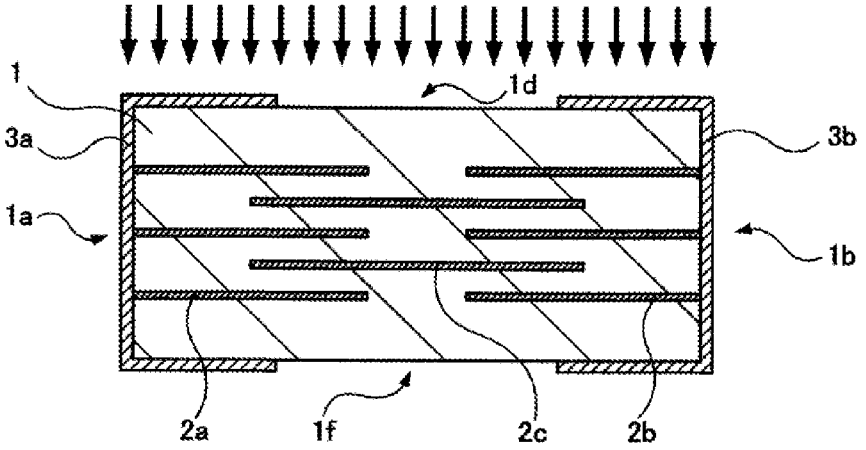
Figure 3D:
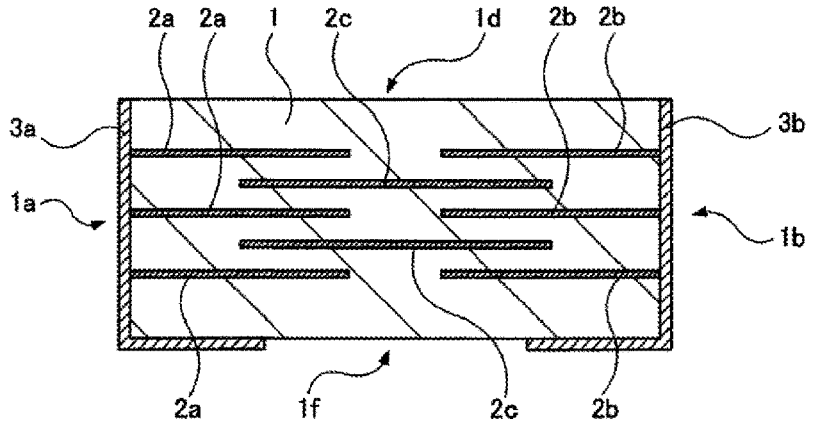
FIGS. 3D to 3F, which follow
Figure 3E:
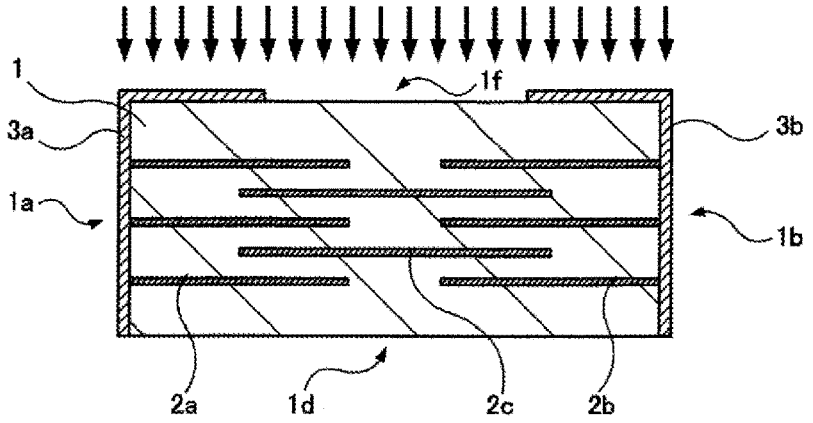

As shown in FIG. 2C, first, the side surface 1*d* of the ceramic element 1 is machined by the predetermined amount. The machining is able to be performed by, for example, sandblasting, dicing, wet blasting, or lap polishing. Covering with, for example, a protection film before the machining is not needed over a portion of the ceramic element 1. A plurality of ceramic elements 1 classified into the same group may be fixed to, for example, a jig, and machined all at once. FIG. 3D shows the ceramic element 1 after the side surface 1*d* is machined.

Figure 3F:
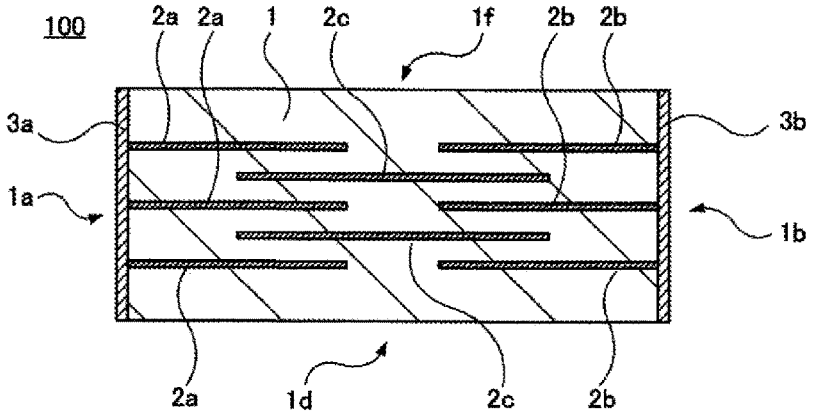

Subsequently, as shown in FIG. 3F, the ceramic element 1 is turned over to machine the side surface 1*f* of the ceramic element 1 by the predetermined amount.

When the machining of the side surface 1*f* of the ceramic element 1 is finished, the NTC thermistor 100 according to the present preferred embodiment is completed. The NTC thermistor 100 has a precisely adjusted resistance value within the desired range of the target resistance value.

Second Preferred Embodiment

Figure 6A:
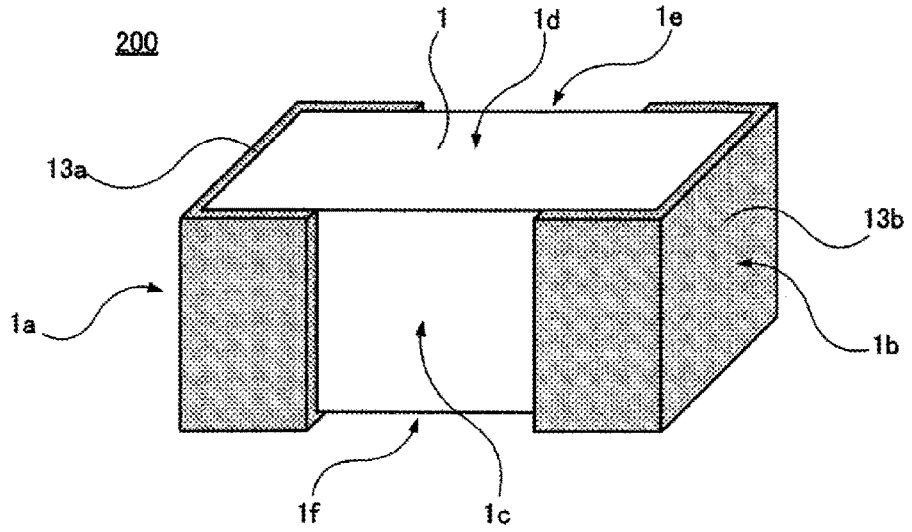
FIG. 6A is a perspective view showing an NTC thermistor according to a second preferred embodiment of the present invention.

FIG. 6A shows a chip NTC thermistor 200 as an electronic component according to a second preferred embodiment of the present invention.

The NTC thermistor 200 has an adjusted resistance value provided by machining only the one side surface 1*d* of the ceramic element 1 together with external electrodes 13*a* and 13*b* through the side surface machining process. The rest of the configuration of the NTC thermistor 200 and a method of manufacturing the same are the same as or similar to the configuration of the NTC thermistor 100 and the method for manufacturing the same according to the first preferred embodiment described above.

Third Preferred Embodiment

Figure 6B:
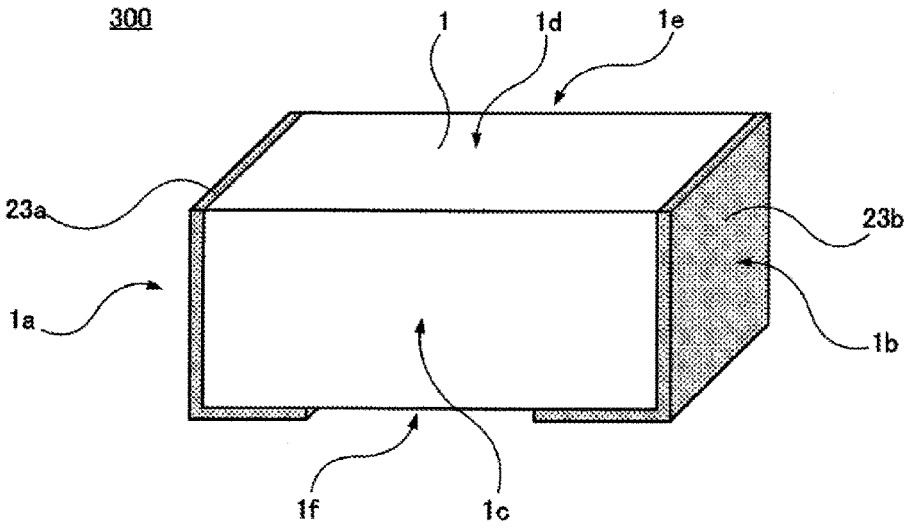
FIG. 6B is a perspective view showing an NTC thermistor according to a third preferred embodiment of the present invention.

FIG. 6B shows a chip NTC thermistor 300 as an electronic component according to a third preferred embodiment of the present invention.

The NTC thermistor 300 has an adjusted resistance value provided by machining the three continuous side surfaces 1*c*, 1*d*, and 1*e* of the ceramic element 1 together with external electrodes 23*a* and 23*b* through the side surface machining process. The rest of the configuration of the NTC thermistor 300 and a method of manufacturing the same are the same as or similar to the configuration of the NTC thermistor 100 and the method for manufacturing the same according to the first preferred embodiment described above.

Fourth Preferred Embodiment

Figure 7:
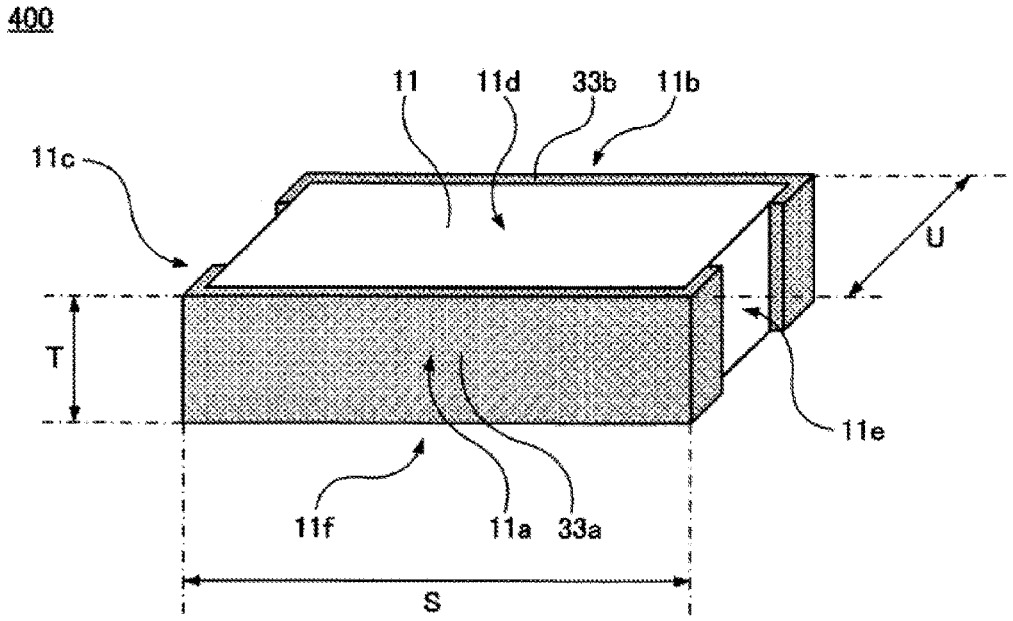
FIG. 7 is a perspective view showing an NTC thermistor according to a fourth preferred embodiment of the present invention.

FIG. 7 shows a chip NTC thermistor 400 as an electronic component according to a fourth preferred embodiment of the present invention.

In the NTC thermistor 400 according to the present preferred embodiment, a ceramic element 11 to be described below has a shape different from the shapes of the NTC thermistors 100 to 300 according to the first to third preferred embodiments described above.

The NTC thermistor 400 includes the ceramic element 11 with a rectangular parallelepiped or a substantially rectangular parallelepiped shape including one pair of end surfaces 11*a* and 11*b* and four side surfaces 11*c*, 11*d*, 11*e*, and 11*f* connecting the end surfaces 11*a* and 11*b*.

In the NTC thermistor 400, each of the end surfaces 11*a* and 11*b* of the ceramic element 11 is rectangular or substantially rectangular including a first side having a length S and a second side having a length T, which are orthogonal or substantially orthogonal to each other. The length S of the first side is longer than or equal to the length T of the second side. The length S of the first side as the longer side is longer than a length U of each of the side surfaces 11*c* and 11*d*, 11*e*, and 11*f* between the end surfaces 11*a* and 11*b*.

Specific dimensions of the lengths S, T, and U are optional, and may be, for example, dimensions of S=about 1.6 mm, about 0.5 mm≤T≤about 1.6 mm, and U=about 0.8 mm.

The external electrodes 33*a* and 33*b* are formed at both end portions of the ceramic element 11.

The external electrode 33*a* is provided on the end surface 11*a* as one end surface of the ceramic element 11 and extends to the two side surfaces 11*c* and 11*e* over two facing sides of four sides surrounding the end surface 11*a*. The external electrode 33*b* is provided on the end surface 11*b* as the other end surface of the ceramic element 11 and extends to the two side surfaces 11*c* and 11*e* over two facing sides of four sides surrounding the end surface 11*b*.

The external electrodes 33*a* and 33*b* preferably have cap shapes at the respective end portions of the ceramic element 11 in advance, and then formed in the above-described shape by machining the side surfaces 11*d* and 11*f* of the ceramic element 11 to be flush or substantially flush with each other to adjust the resistance value.

In the NTC thermistor 400 according to the fourth preferred embodiment, the side surfaces 11*d* and 11*f* of the ceramic element 11 are machined to adjust the resistance value. However, as a modification, any one of the four side surfaces 11*c* to 11*f* of the ceramic element 11 may be machined to be flush or substantially flush with the external electrodes 33*a* and 33*b*. Alternatively, as another modification, three continuous side surfaces of the four side surfaces 11*c* to 11*f* of the ceramic element 11 may be machined to be flush or substantially flush with the external electrodes 33*a* and 33*b*.

The NTC thermistor 400 according to the fourth preferred embodiment is able to be manufactured through processes the same as or similar to the processes included in the method for manufacturing the NTC thermistor 100 according to the first preferred embodiment described above. Specifically, the NTC thermistor 400 is able to be manufactured by a manufacturing method including ceramic element manufacturing process, external electrode forming process, initial characteristic value measuring process, machining condition determining process, and the side surface machining process.

Fifth Preferred Embodiment

Figure 8A:
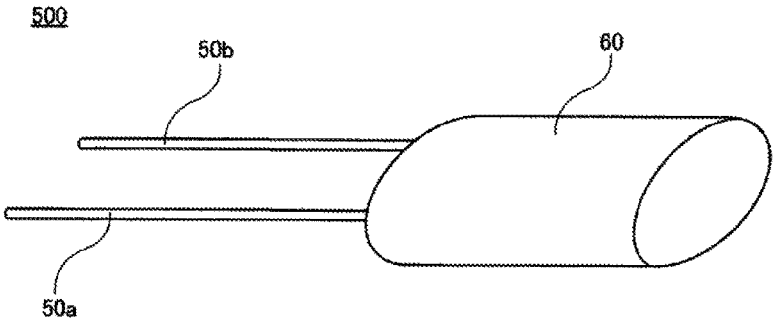
FIG. 8A is a perspective view showing an NTC thermistor according to a fifth preferred embodiment of the present invention.
Figure 8B:
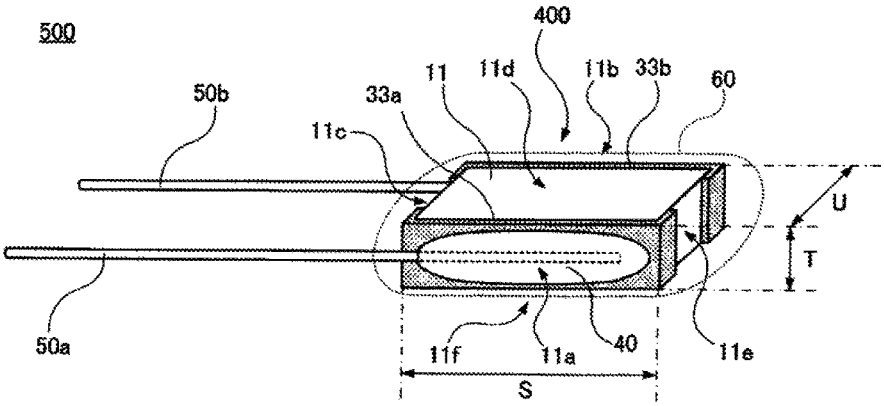
FIG. 8B is an exploded perspective view of the NTC thermistor shown in FIG. 8A without its exterior.

FIGS. 8A and 8B show an NTC thermistor 500 as an electronic component according to a fifth preferred embodiment of the present invention. FIG. 8A is a perspective view of the NTC thermistor 500. FIG. 8B is an exploded perspective view of the NTC thermistor 500 without an exterior 60 to be described below.

The NTC thermistor 500 is a lead-terminal NTC thermistor provided by joining one pair of lead terminals 50*a* and 50*b* to be described below with the chip NTC thermistor 400 according to the fourth preferred embodiment shown in FIG. 7.

As shown in FIG. 8B, the NTC thermistor 500 includes the NTC thermistor 400.

The NTC thermistor 400 includes the ceramic element 11 including one pair of the end surfaces 11*a* and 11*b* and the four side surfaces 11*c*, 11*d*, 11*e*, and 11*f*. Each of the end surfaces 11*a* and 11*b* is rectangular or substantially rectangular including a first side having a length S and a second side having a length T, which are orthogonal or substantially orthogonal to each other. The length S of the first side is longer than the length T of the second side and longer than a length U of each of the side surfaces 11*c* and 11*d*, 11*e*, and 11*f* between the end surfaces 11*a* and 11*b*.

The external electrodes 33*a* and 33*b* are provided on the ceramic element 11. The external electrode 33*a* is provided on the end surface 11*a* as one end surface of the ceramic element 11 and extends to the two side surfaces 11*c* and 11*e* over two facing sides of four sides surrounding the end surface 11*a*. The external electrode 33*b* is provided on the end surface 11*b* as the other end surface of the ceramic element 11 and extends to the two side surfaces 11*c* and 11*e* over two facing sides of four sides surrounding the end surface 11*b*.

The external electrodes 33*a* and 33*b* are joined with lead terminals 50*a* and 50*b*, respectively, by a joining material 40. The joining material 40 is, for example, solder or conductive adhesive agent. The lead terminals 50*a* and 50*b* preferably include an alloy containing Fe as a primary component or an alloy containing Cu as a primary component, for example.

In the NTC thermistor 500 according to the present preferred embodiment, the lead terminals 50*a* and 50*b* are joined in parallel or substantially in parallel to the first side having the length S of each of the end surfaces 11*a* and 11*b* of the ceramic element 11. The first side having the length S is a side of the ceramic element 1 having a greatest length and is longer than the lengths T and U as shown in FIG. 8B.

In the NTC thermistor 500 with the configuration described above, the lead terminals 50*a* and 50*b* are in contact with the external electrodes 33*a* and 33*b*, respectively, over longer lengths. In addition, the lead terminals 50*a* and 50*b* are able to be joined with the external electrodes 33*a* and 33*b*, respectively, through a sufficient amount of the joining material 40. Accordingly, in the NTC thermistor 500, the lead terminals 50*a* and 50*b* are solidly joined with the external electrodes 33*a* and 33*b*, respectively.

The exterior 60 is provided as shown in FIG. 8A, leaving one end of each of the lead terminals 50*a* and 50*b* externally exposed. The exterior 60 includes, for example, resin such as epoxy resin or glass. The exterior 60 protects a body portion of the NTC thermistor 500.

The NTC thermistor 500 according to the present preferred embodiment, which has the above-described structure, is able to be manufactured by, for example, the following method.

First, the NTC thermistor 400 according to the fourth preferred embodiment is prepared. The NTC thermistor 400 is manufactured at least through the ceramic element manufacturing process, the external electrode forming process, the initial characteristic value measuring process, the machining condition determining process, and the side surface machining process. The NTC thermistor 400 has a high characteristic accuracy when manufactured through the initial characteristic value measuring process, the machining condition determining process, and the side surface machining process.

Subsequently, as a lead terminal joining process, the external electrodes 33*a* and 33*b* of the NTC thermistor 400 are joined with the lead terminals 50*a* and 50*b*, respectively, by the joining material 40.

Thereafter, a characteristic value adjusting process may be performed as an optional process. The characteristic value adjusting process is performed to adjust, again into a desired range, a characteristic value shifted due to, for example, the joining of the lead terminals 50*a* and 50*b*. The characteristic value adjusting process may include, for example, a characteristic value measuring process, a machining condition determining process, and a side surface machining process.

Similarly to the machining condition determining process in the method of manufacturing the NTC thermistor 100 according to the first preferred embodiment described above, the machining condition determining process may be performed or is preferably performed, for example, by using a previously produced correlation diagram between the machining amount and change of the characteristic value. The machining condition determining process is preferably performed, for example, in consideration of the change of the characteristic value through an exterior forming process performed next.

Lastly, as an exterior sealing process, the ceramic element 11 is sealed by the exterior 60, leaving one end of each of the lead terminals 50*a* and 50*b* externally exposed. This completes the NTC thermistor 500 according to the present preferred embodiment.

Sixth Preferred Embodiment

Figure 9:
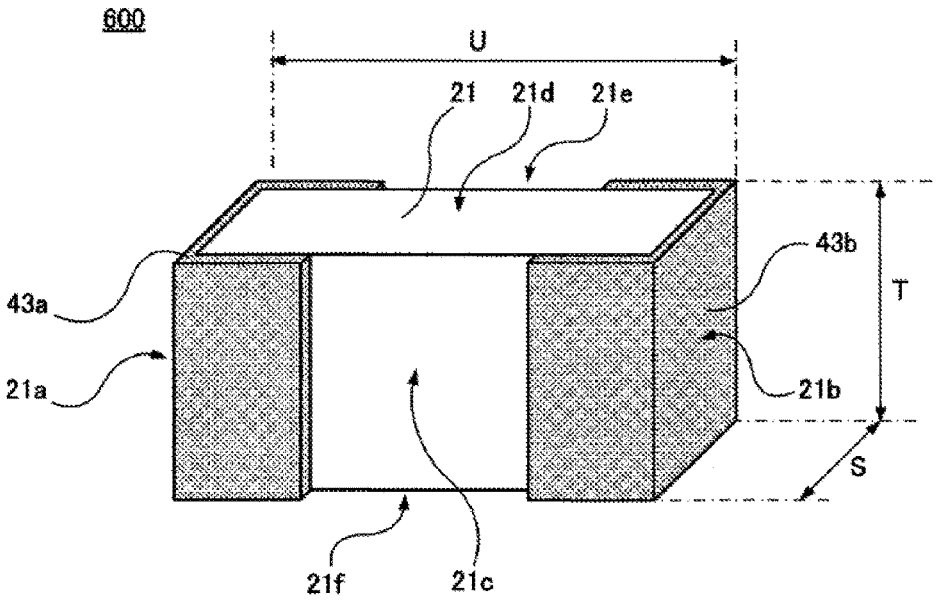
FIG. 9 is a perspective view showing an NTC thermistor according to a sixth preferred embodiment of the present invention.

FIG. 9 shows a chip NTC thermistor 600 as an electronic component according to a sixth preferred embodiment of the present invention.

The NTC thermistor 600 according to the present preferred embodiment is provided by changing the NTC thermistor 100 according to the first preferred embodiment shown in FIGS. 1A and 1B. Specifically, the ceramic element 1 of the NTC thermistor 100 is replaced by a ceramic element 21 having a different shape.

The NTC thermistor 600 includes the ceramic element 21 with a rectangular parallelepiped or a substantially rectangular parallelepiped shape including one pair of end surfaces 21*a* and 21*b* and four side surfaces 21*c*, 21*d*, 21*e*, and 21*f* connecting the end surfaces 21*a* and 21*b*.

In the NTC thermistor 600, each of the end surfaces 21*a* and 21*b* of the ceramic element 21 is rectangular or substantially rectangular including a first side having a length S and a second side having a length T, which are orthogonal or substantially orthogonal to each other. The length T of the second side is longer than the length S of the first side. The length T of the second side as the longer side is less than or equal to a length U of each of the side surfaces 21*c*, 21*d*, 21*e*, and 21*f* between the end surfaces 21*a* and 21*b*.

Specific dimensions of the lengths S, T, and U are optional, and may be, for example, dimensions of S=about 0.8 mm, about 0.8 mm<T≤about 1.6 mm, and U=about 1.6 mm.

External electrodes 43*a* and 43*b* are provided at both end portions of the ceramic element 21.

The external electrode 43*a* is provided on the end surface 21*a* as one end surface of the ceramic element 21 and extends to two side surfaces 21*c* and 21*e* over two facing sides of four sides surrounding the end surface 21*a*. The external electrode 43*b* is provided on the end surface 21*b* as the other end surface of the ceramic element 21 and extends to two side surfaces 21*c* and 21*e* over two facing sides of four sides surrounding the end surface 21*b*.

The external electrodes 43*a* and 43*b* are provided in cap shapes at both end portions of the ceramic element 21 in advance, and then formed in the above-described shape by machining the side surfaces 21*d* and 21*f* of the ceramic element 21 to be flush or substantially flush with each other to adjust the resistance value.

In the NTC thermistor 600 according to the sixth preferred embodiment, a length T of a second side of each of the end surfaces 21*a* and 21*b* is longer than the length T of the second side of each of the end surfaces 1*a* and 1*b* of the NTC thermistor 100 according to the first preferred embodiment, and thus the side surfaces 21*d* and 21*f* of the ceramic element 21 are able to be greatly machined to adjust the resistance value. The shape of the NTC thermistor 600 is desirable when the characteristic value is significantly adjusted.

In the NTC thermistor 600 according to the sixth preferred embodiment, the side surfaces 21*d* and 21*f* of the ceramic element 21 are machined to adjust the resistance value. Instead, as a modification, any one of the four side surfaces 21*c* to 21*f* of the ceramic element 21 may be machined to be flush or substantially flush with the external electrodes 43*a* and 43*b*. Alternatively, as another modification, three continuous side surfaces of the four side surfaces 21*c* to 21*f* of the ceramic element 21 may be machined to be flush or substantially flush with the external electrodes 43*a* and 43*b*.

Seventh Preferred Embodiment

Figure 10:
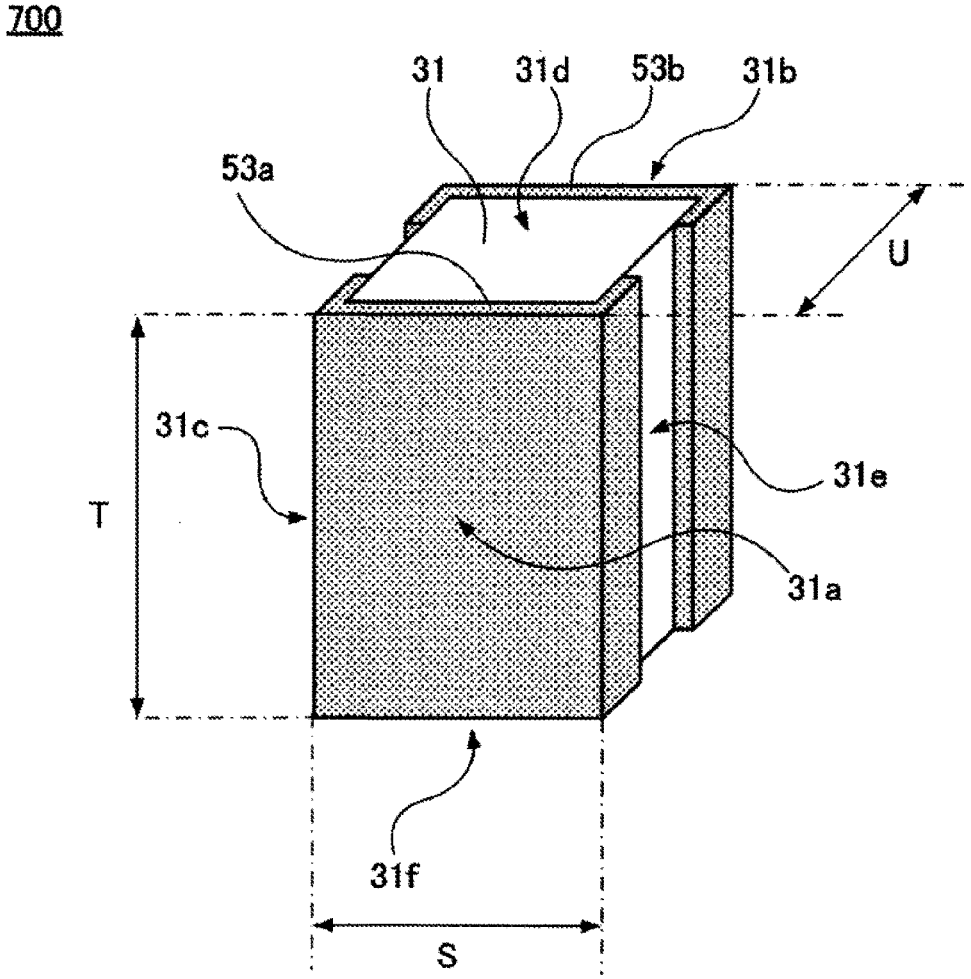
FIG. 10 is a perspective view showing an NTC thermistor according to a seventh preferred embodiment of the present invention.

FIG. 10 shows a chip NTC thermistor 700 as an electronic component according to a seventh preferred embodiment of the present invention.

The NTC thermistor 700 according to the present preferred embodiment is provided by changing the NTC thermistor 400 according to the fourth preferred embodiment shown in FIG. 7. Specifically, the ceramic element 11 of the NTC thermistor 400 is replaced by a ceramic element 31 having a different shape.

The NTC thermistor 700 includes the ceramic element 31 with a rectangular parallelepiped or a substantially rectangular parallelepiped shape including one pair of end surfaces 31*a* and 31*b* and four side surfaces 31*c*, 31*d*, 31*e*, and 31*f* connecting the end surfaces 31*a* and 31*b*.

In the NTC thermistor 700, each of the end surfaces 31*a* and 31*b* of the ceramic element 31 is rectangular or substantially rectangular including a first side having a length S and a second side having a length T, which are orthogonal or substantially orthogonal to each other. The length T of the second side is longer than or equal to the length S of the first side. The length T of the second side as the longer side is longer than a length U of each of the side surfaces 31*c*, 31*d*, 31*e*, and 31*f* between the end surfaces 31*a* and 31*b*.

Specific dimensions of the lengths S, T, and U are optional, and may be, for example, dimensions of S=about 1.2 mm, about 1.2 mm≤T≤about 1.6 mm, and U=about 0.8 mm.

External electrodes 53*a* and 53*b* are provided at both end portions of the ceramic element 31.

The external electrode 53*a* is provided on the end surface 31*a* as one end surface of the ceramic element 31 and extends to two side surfaces 31*c* and 31*e* over two facing sides of four sides surrounding the end surface 31*a*. The external electrode 53*b* is provided on the end surface 31*b* as the other end surface of the ceramic element 31 and extends to two side surfaces 31*c* and 31*e* over two facing sides of four sides surrounding the end surface 31*b*.

The external electrodes 53*a* and 53*b* are preferably provided in cap shapes at both end portions of the ceramic element 31 in advance, and then formed in the above-described shape by machining the side surfaces 31*d* and 31*f* of the ceramic element 31 to be flush or substantially flush with each other to adjust the resistance value.

In the NTC thermistor 700 according to the seventh preferred embodiment, the length T of the second side of each of the end surfaces 31*a* and 31*b* is longer than the length T of the second side of each of the end surfaces 11*a* and 11*b* of the NTC thermistor 400 according to the fourth preferred embodiment, and thus the side surfaces 31*d* and 31*f* of the ceramic element 31 are able to be greatly machined to adjust the resistance value. The shape of the NTC thermistor 700 is desirable when the characteristic value is significantly adjusted.

To provide a lead-terminal NTC thermistor by joining one pair of lead terminals (not shown in the drawings) with the NTC thermistor 700, the lead terminals are preferably disposed, for example, in parallel or substantially in parallel to the second sides, each having the length T, of the end surfaces 31*a* and 31*b* of the ceramic element 31 and joined with the external electrodes 53*a* and 53*b*. In this case, the lead terminals are in contact with the external electrodes 53*a* and 53*b* over longer lengths. In addition, the lead terminals are able to be joined with the external electrodes 53*a* and 53*b* through a sufficient amount of the joining material. Accordingly, the lead terminals are able to be solidly joined with the external electrodes 53*a* and 53*b*.

In the NTC thermistor 700 according to the seventh preferred embodiment, the side surfaces 31*d* and 31*f* of the ceramic element 31 are machined to adjust the resistance value. Instead, as a modification, any one of the four side surfaces 31*c* to 31*f* of the ceramic element 31 may be machined to be flush or substantially flush with the external electrodes 53*a* and 53*b*. Alternatively, as another modification, three continuous side surfaces of the four side surfaces 31*c* to 31*f* of the ceramic element 31 may be machined to be flush or substantially flush with the external electrodes 53*a* and 53*b*.

Eighth Preferred Embodiment

Figure 11A:
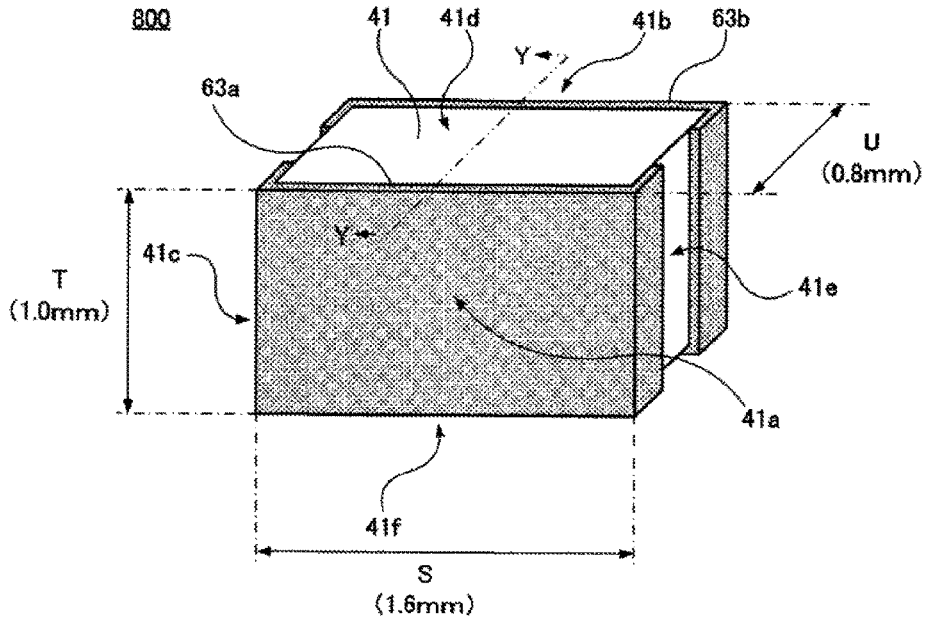
FIG. 11A is a perspective view showing an NTC thermistor according to an eighth preferred embodiment of the present invention.
Figure 11B:
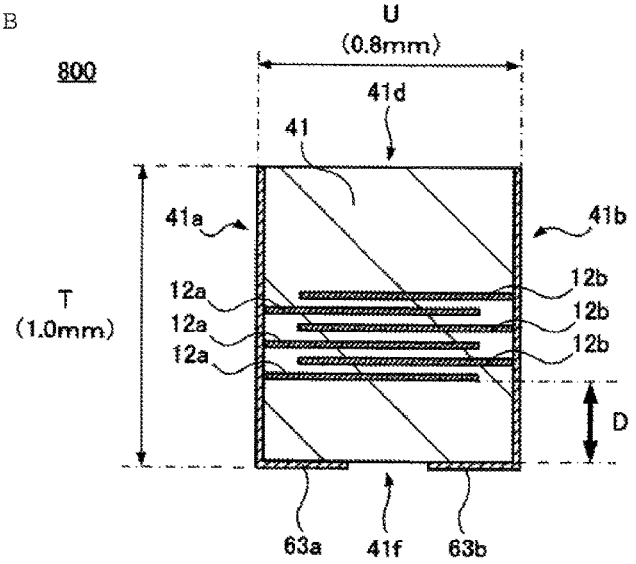
FIG. 11B is a cross-sectional view taken along line X-X in FIG. 11A.

FIGS. 11A and 11B show a chip NTC thermistor 800 as an electronic component according to an eighth preferred embodiment of the present invention. FIG. 11A is a perspective view, and FIG. 11B is a cross-sectional view taken along line Y-Y in FIG. 11A.

The NTC thermistor 800 includes a ceramic element 41 with a rectangular parallelepiped or a substantially rectangular parallelepiped shape including one pair of end surfaces 41*a* and 41*b* and four side surfaces 41*c*, 41*d*, 41*e*, and 41*f* connecting the end surfaces 41*a* and 41*b*.

In the NTC thermistor 800, each of end surfaces 41*a* and 41*b* of the ceramic element 41 is rectangular or substantially rectangular including a first side having a length S and a second side having a length T, which are orthogonal or substantially orthogonal to each other. A length U is the distance between the end surfaces 41*a* and 41*b*.

In the present preferred embodiment, specific dimensions of the lengths S, T, and U of the NTC thermistor 800 preferably are S=about 1.6 mm, T=about 1.0 mm, and U=about 0.8 mm, for example. However, each dimension may be changed as desired.

External electrodes 63*a* and 63*b* are provided at both end portions of the ceramic element 41.

The external electrode 63*a* is provided on the end surface 41*a* as one end surface of the ceramic element 41 and extends to the three side surfaces 41*c*, 41*e*, and 41*f* over three sides of four sides surrounding the end surface 41*a*. The external electrode 63*b* is provided on the end surface 41*b* as the other end surface of the ceramic element 41 and extends to the three side surfaces 41*c*, 41*e*, and 41*f* over three sides of four sides surrounding the end surface 41*b*. In other words, neither of the external electrodes 63*a* and 63*b* are extended to the side surface 41*d* of the ceramic element 41.

The external electrodes 63*a* and 63*b* are preferably provided in cap shapes at both end portions of the ceramic element 41 in advance, and then formed in the above-described shape by machining the side surface 41*d* of the ceramic element 41 to be flush or substantially flush to adjust the resistance value.

As shown in FIG. 11B, an internal electrode 12*a* connected with the external electrode 63*a*, and an internal electrode 12*b* connected with the external electrode 63*b* are provided inside the ceramic element 41. The internal electrodes 12*a* and 12*b* have widths of about 20 μm, approximately.

In the NTC thermistor 800 according to the present preferred embodiment, a distance D from the external electrode 63*b* on the side surface 41*f* of the ceramic element 41 to the nearest internal electrode 12*a* is set to be longer than about 225 μm. The distance D, which is the distance from the side surface 41*f* of the ceramic element 41 to the nearest internal electrode 12*a*, is the thickness of a protection layer.

In the NTC thermistor 800, the distance D is set to be longer than about 225 μm to reduce change of the resistance of the NTC thermistor 800 due to heat when the NTC thermistor 800 is mounted by soldering. In other words, change of the resistance due to heat when the NTC thermistor 800 is mounted by soldering is able to be reduced when the distance D is set to be longer than about 225 μm, for example. This finding was acquired through the following experiment performed by the inventors of the present invention.

Figure 12A:
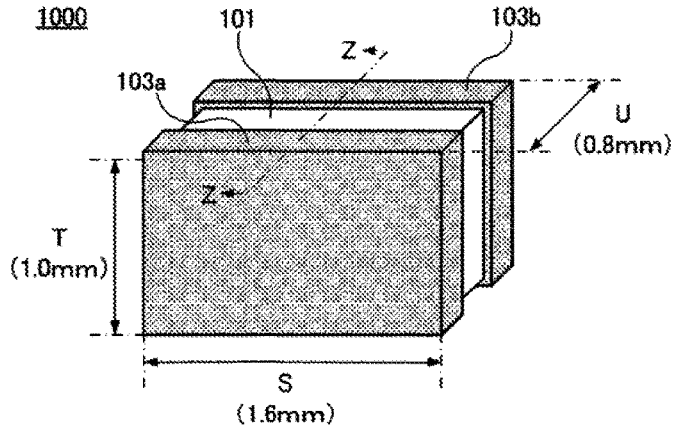
FIG. 12A is a perspective view showing an NTC thermistor according to a Reference Example.

FIG. 12A shows an NTC thermistor 1000 according to a Reference Example. The NTC thermistor 1000 includes a ceramic element 101 having dimensions of S=about 1.6 mm, T=about 1.0 mm, and U=about 0.8 mm. External electrodes 103*a* and 103*b* in cap shapes are formed at both end portions of the ceramic element 101. Unlike the present invention, side surfaces of the ceramic element 101 are not machined.

Figures 1, 12B:
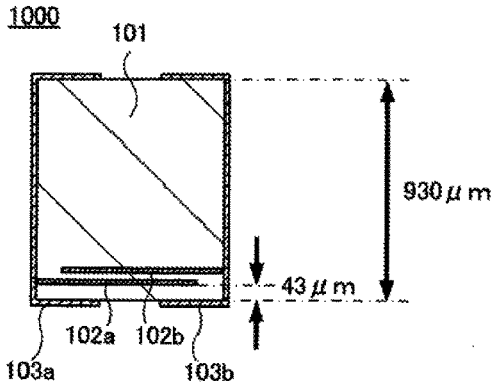
FIGS. 12B-1, 12B-2, and 12B-3 are cross-sectional views of the NTC thermistor shown in FIG. 12A including a protection layer having different thicknesses.
Figures 2, 12B:
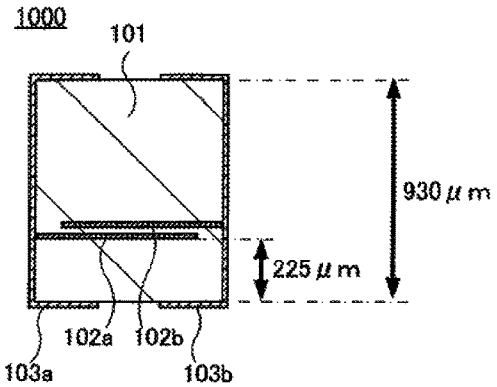
Figures 3, 12B:
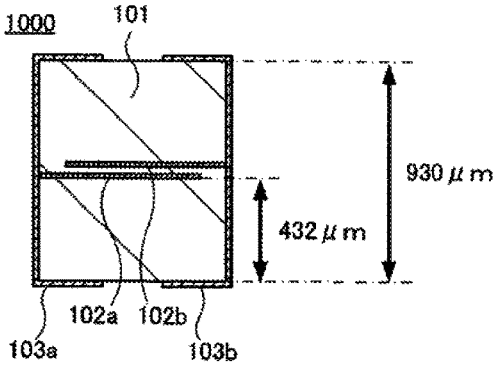

In the NTC thermistor 1000 according to the Reference Example, an internal electrode 102*a* connected with the external electrode 103*a*, and an internal electrode 102*b* connected with the external electrode 103*b* are provided inside the ceramic element 101 as shown in FIGS. 12B-1 to 12B-3. FIGS. 12B-1 to 12B-3 show thermistors different from each other, between which the distance from the external electrode 103*b* on the bottom surface of the ceramic element 101 to the internal electrode 102*a* differs. Specifically, FIG. 12B-1 shows an example in which the distance from the external electrode 103*b* to the internal electrode 102*a* is about 43 μm. FIG. 12B-2 shows an example in which the distance from the external electrode 103*b* to the internal electrode 102*a* is about 225 μm. FIG. 12B-3 shows an example in which the distance from the external electrode 103*b* to the internal electrode 102*a* is about 432 μm.

In addition to the three examples described above and shown in FIGS. 12B-1 to 12B-3, the NTC thermistor 1000 was manufactured as a plurality of specimens with different distances from the external electrode 103*b* on the bottom surface of the ceramic element 101 to the internal electrode 102*a*. Then, all specimens were each mounted on a substrate by reflow soldering to measure a resistance change rate through the mounting.

Figure 13:
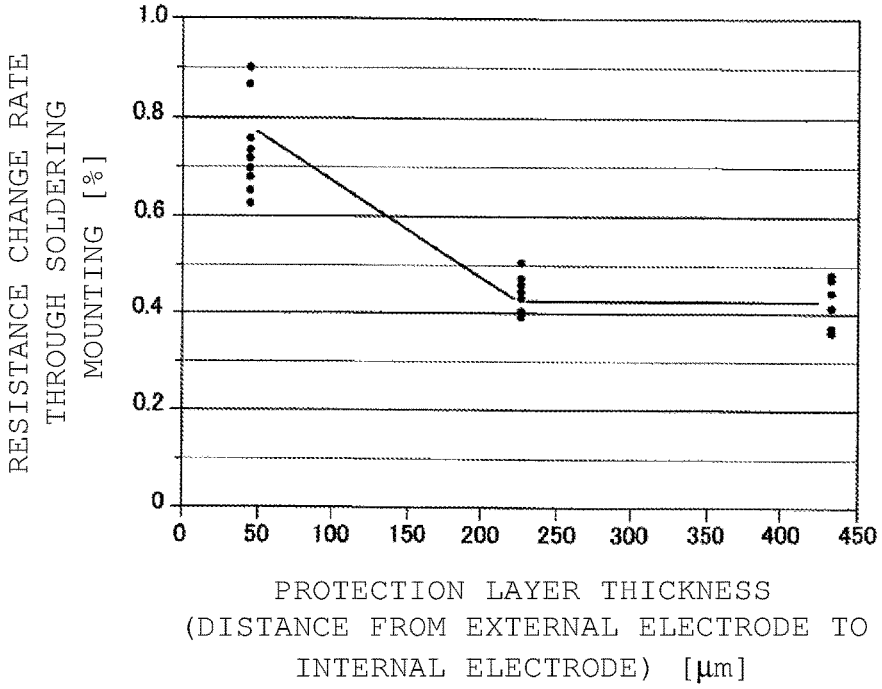
FIG. 13 is a graph showing a relationship between the thickness of the protection layer of the NTC thermistor shown in FIG. 12A and a resistance change rate through soldering mounting.

FIG. 13 shows a relationship between the distance from the external electrode 103*b* on the bottom surface of the ceramic element 101 to the internal electrode 102*a* (for example, the thickness of the protection layer) and the resistance change rate through the mounting by soldering.

As shown FIG. 13, when the thickness of the protection layer is not greater than about 225 μm, the resistance change rate proportionally decreases as the thickness increases. However, when the thickness of the protection layer is greater than about 225 μm, the resistance change rate does not significantly decrease further.

The resistance of the NTC thermistor 1000 receives largest contribution from a resistance component between the internal electrodes 102*a* and 102*b*, but also receives contributions from a resistance component between the internal electrode 102*a* and the external electrode 103*b* at different potentials, and from a resistance component between the internal electrode 102*b* and the external electrode 103*a* at different potentials.

When the NTC thermistor 1000 is mounted on a substrate by soldering, an oxygen reaction occurs, and the ceramic is oxidized at a portion near the surface of the ceramic element 101 due to heat of the mounting, thus increasing the resistance value of the portion. The increase in the resistance value at the portion near the surface of the ceramic element 101 increases the resistance between the internal electrode 102*a* and the external electrode 103*b* and the resistance between the internal electrode 102*b* and the external electrode 103*a*. Accordingly, the resistance of the NTC thermistor 1000, that is, the resistance between the external electrodes 103*a* and 103*b*, increases. This increase in resistance can be a primary cause of variation in the resistance when the NTC thermistor 1000 is mounted on the substrate by soldering.

However, as shown in FIG. 13, when the thickness of the protection layer is greater than about 225 μm and the internal electrode 102*a* and the internal electrode 102*b* are disposed more inside in the direction of the length T of the ceramic element 101, a change of the resistance between the internal electrode 102*a* and the external electrode 103*b* and a change of the resistance between the internal electrode 102*b* and the external electrode 103*a*, which are caused by heat of the mounting by soldering, are able to be reduced.

Accordingly, in the NTC thermistor 800 according to the eighth preferred embodiment, the distance D from the external electrode 63*b* on the side surface 41*f* of the ceramic element 41 to the nearest internal electrode 12*a* was set to be longer than about 225 μm based on the above-described finding. The NTC thermistor 800 undergoes a reduced change of the resistance due to heat when mounted by soldering.

It was discovered that the technology of reducing change of the resistance due to heat at the soldering mounting, in which the distance (for example, the thickness of the protection layer) from an external electrode on the bottom surface or the top surface to a nearest internal electrode is set to be longer than about 225 μm, provides a greater effect on an NTC thermistor including a ceramic element having dimensions longer than a width of about 0.5 mm, a thickness of about 0.5 mm, and a length of about 1.0 mm, for example.

The above description is provided with respect to the exemplary structures of the NTC thermistors 100 to 800 according to the first to eighth preferred embodiments of the present invention, and the exemplary methods of manufacturing the same. However, the present invention is not limited to the above-described configurations, and various modifications are possible without departing from the scope of the present invention.

For example, an NTC thermistor is described as an electronic component in each above-described preferred embodiment. However, electronic components according to preferred embodiments of the present invention is not limited to an NTC thermistor, but may be, for example, a coil, a capacitor, or a resistance. Alternatively, the electronic component may be a PTC thermistor in place of an NTC thermistor, for example.

An adjusted characteristic value is not limited to the resistance value, but may be, for example, the inductance value or the capacitance value.

The appearance of a ceramic element may have various kinds of shapes and dimensions. For example, the ceramic element may be cube or substantially cube shaped, all sides of which have equal or substantially equal lengths.

It was discovered that preferred embodiments of the present invention are effective at least for the electronic component 100 according to the first preferred embodiment shown in FIGS. 1A and 1B, which includes the ceramic element 1 having a shape with dimensions of S=about 0.8 mm, about 0.5 mm≤T≤about 0.8 mm, and U=about 1.6 mm, for example.

It was also discovered that the present invention is effective for the electronic component 400 according to the fourth preferred embodiment shown in FIG. 7, which includes the ceramic element 11 having a shape with dimensions of S=about 1.6 mm, about 0.5 mm≤T≤about 1.6 mm, and U=about 0.8 mm, for example.

It was also discovered that preferred embodiments of the present invention are effective for electronic component 600 according to the sixth preferred embodiment shown in FIG. 9, which includes the ceramic element 21 having a shape with dimensions of S=about 0.8 mm, about 0.8 mm<T≤about 1.6 mm, and U=about 1.6 mm, for example.

It was also discovered that preferred embodiments of the present invention is effective for the electronic component 700 according to the seventh preferred embodiment shown in FIG. 10, which includes the ceramic element 31 having a shape with dimensions of S=about 1.2 mm, about 1.2 mm≤T≤about 1.6 mm, and U=about 0.8 mm, for example.

The number of side surfaces of a ceramic element, which are machined to be flush or substantially flush with each other, may be optionally selected from among one to three.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A method of manufacturing an electronic component, the method comprising:

a ceramic element manufacturing process of manufacturing a ceramic element including one pair of end surfaces and four side surfaces each connecting the end surfaces;

an external electrode forming process of forming, at both end portions of the ceramic element, one pair of external electrodes each with a cap shape over the corresponding end surface and the four side surfaces continuous with the end surface;

an initial characteristic value measuring process of measuring an initial characteristic value between the external electrodes;

a machining condition determining process of determining one side surface, two side surfaces, or three side surfaces to be machined from among the four side surfaces and then determining, based on stored data, an amount of machining to be performed on the determined one side surface, two side surfaces, or three side surfaces by comparing the initial characteristic value measured through the initial characteristic value measuring process and a predetermined target characteristic value; and a side surface machining process of machining the determined one side surface, two side surfaces, or three side surfaces to be flush or substantially flush with the external electrodes formed on the side surface by the machining amount determined by the machining condition determining process; wherein the ceramic element is a thermistor element, and the electronic component is a thermistor.

2. The method of manufacturing an electronic component according to claim 1, wherein the characteristic value is a resistance value.

3. The method of manufacturing an electronic component according to claim 1, wherein the external electrode forming process includes a baked external electrode forming process of forming a baked external electrode at each end portion of the ceramic element by applying and baking conductive paste.

4. The method of manufacturing an electronic component according to claim 1, wherein the external electrode forming process includes:

a baked external electrode forming process of forming a baked external electrode at each end portion of the ceramic element by applying and baking conductive paste; and a plated external electrode forming process of forming a plated external electrode on the baked external electrode by plating.

5. The method of manufacturing an electronic component according to claim 1, wherein each of the external electrodes is in ohmic contact with the ceramic element.

6. The method of manufacturing an electronic component according to claim 1, wherein an internal electrode is formed inside the ceramic element.

7. The method of manufacturing an electronic component according to claim 1, wherein each end surface of the ceramic element is rectangular or substantially rectangular including a first side and a second side orthogonal or substantially orthogonal to each other, and a length of a longer one of the first and second sides is less than or equal to a length of each side surface between the end surfaces.

8. The method of manufacturing an electronic component according to claim 7, wherein the length of the first side is different from the length of the second side.

9. The method of manufacturing an electronic component according to claim 1, wherein each end surface of the ceramic element is rectangular or substantially rectangular including a first side and a second side orthogonal or substantially orthogonal to each other, and a length of a longer one of the first and second sides is longer than a length of each side surface between the end surfaces.

10. The method of manufacturing an electronic component according to claim 1, further comprising a lead terminal joining process of joining a lead terminal with each external electrode.

11. The method of manufacturing an electronic component according to claim 10, further comprising, after the lead terminal joining process, a characteristic value adjusting process of adjusting the characteristic value by machining the ceramic element or machining the ceramic element and the external electrodes.

12. The method of manufacturing an electronic component according to claim 10, further comprising an exterior sealing process of sealing, by an exterior, the ceramic element on which the external electrodes are formed, leaving one end of each lead terminal externally exposed.

13. An electronic component comprising:

a ceramic element including one pair of end surfaces and four side surfaces each connecting the end surfaces; and one pair of external electrodes provided on both end surfaces of the ceramic element;

wherein each external electrode extends from the corresponding end surface to one side surface, two side surfaces, or three side surfaces of the four side surfaces continuous with the end surface over a side surrounding the end surface;

any of the four side surfaces of the ceramic element, to which no external electrode extends, is machined to be flush or substantially flush;

each end surface of the ceramic element is rectangular or substantially rectangular including a first side and a second side orthogonal or substantially orthogonal to each other, and a length of a longer one of the first and second sides is less than or equal to a length of each side surface between the end surfaces; and the length of the first side is different from the length of the second side.

14. The electronic component according to claim 13, wherein each of the external electrodes only includes a baked external electrode provided on the ceramic element.

15. The electronic component according to claim 13, wherein each of the external electrodes includes a baked external electrode provided on the ceramic element and a plated external electrode provided on the baked external electrode.

16. The electronic component according to claim 13, wherein each external electrode is in ohmic contact with the ceramic element.

17. The electronic component according to claim 13, wherein the ceramic element is a thermistor element and the electronic component is a thermistor.

18. The electronic component according to claim 13, wherein an internal electrode is provided inside the ceramic element.

19. The electronic component according to claim 13, wherein each of the external electrodes is joined with a lead terminal.

20. A method of manufacturing an electronic component according to claim 19, wherein the ceramic element on which the external electrodes are provided is sealed by an exterior, leaving one end of each lead terminal externally exposed.

* * * * *